US011015312B2

(12) United States Patent
Becwar

(10) Patent No.: US 11,015,312 B2
(45) Date of Patent: May 25, 2021

(54) METHOD AND APPARATUS FOR SAFELY AND QUICKLY REMOVING SNOW FROM NARROW PEDESTRIAN AND VEHICULAR PATHS

(71) Applicant: Brian Dale Becwar, Robins, IA (US)

(72) Inventor: Brian Dale Becwar, Robins, IA (US)

( * ) Notice: Subject to any disclaimer, the term of this patent is extended or adjusted under 35 U.S.C. 154(b) by 0 days.

(21) Appl. No.: 16/804,074

(22) Filed: Feb. 28, 2020

(65) Prior Publication Data

US 2020/0277745 A1 Sep. 3, 2020

Related U.S. Application Data

(60) Provisional application No. 62/812,727, filed on Mar. 1, 2019.

(51) Int. Cl.

| | |
|---|---|
| ***E01H 5/04*** | (2006.01) |
| ***E01H 5/09*** | (2006.01) |
| ***E01H 5/02*** | (2006.01) |

(52) U.S. Cl.

CPC ..... *E01H 5/045* (2013.01); *E01H 5/02* (2013.01); *E01H 5/098* (2013.01)

(58) Field of Classification Search

CPC .. E01H 5/00; E01H 5/04; E01H 5/045; E01H 5/02; E01H 5/098

See application file for complete search history.

(56) References Cited

U.S. PATENT DOCUMENTS

| | | | | |
|---|---|---|---|---|
| 4,226,034 | A * | 10/1980 | Benjamin | E01H 5/106 126/271.2 C |
| 5,809,755 | A * | 9/1998 | Velke | A01D 34/001 180/19.3 |
| 6,205,753 | B1 * | 3/2001 | Velke | A01D 34/6806 56/14.7 |
| 2014/0173946 | A1 * | 6/2014 | Gerrits | E02F 9/18 37/248 |
| 2015/0047232 | A1 * | 2/2015 | Kassander | E01H 5/09 37/259 |
| 2016/0052567 | A1 * | 2/2016 | Pugh | A01D 43/00 280/638 |
| 2017/0079188 | A1 * | 3/2017 | DeVries | B62D 49/02 |
| 2017/0247052 | A1 * | 8/2017 | Mandeville | B62D 11/006 |
| 2019/0199120 | A1 * | 6/2019 | Hoppel | A01D 43/16 |
| 2019/0217319 | A1 * | 7/2019 | Harvey | B05B 9/06 |

OTHER PUBLICATIONS

Scag Power Equipment—SVRII—V-Ride II Stand-On Mowers screen shot was taken off the url www.scag.com/OPManuals/SVRII?SVRIIOPMANTOC.html.

The Ventrac SSV located at www.ventrac.com/products/tractors/ssv.

Webpage www.bossplow.com/en/products/snowrator/snowrator.

Youtube video "Toro Grandstand with Boss Snow Plow" found at url: https://www.youtube.com/watch?v=8uW_1VJ9meM.

* cited by examiner

*Primary Examiner* — Jamie L McGowan

(74) *Attorney, Agent, or Firm* — Simmons Perrine Moyer Bergman PLC

(57) ABSTRACT

A method and system which provides for a zero turn stand-on snow blower with only two powered wheels and two free-wheeling casters and which provides for the ability to blow snow from narrow paths, turn around without leaving the sidewalk, automatically turn off the auger and present a shovel for performing quick detailed shoveling tasks when stepping off the snow blower.

9 Claims, 9 Drawing Sheets

METHOD AND APPARATUS FOR SAFELY AND QUICKLY REMOVING SNOW FROM NARROW PEDESTRIAN AND VEHICULAR PATHS

FIELD OF THE INVENTION

The present invention generally relates to snow removal, and more particularly relates to commercial use snow blowers and, even more particularly, relates to rapid snow removal using zero-turn stand-on snow blowers.

BACKGROUND OF THE INVENTION

In the past, walk-behind snow blowers have been used by homeowners as well as commercial snow removal companies. Often these walk-behind snow blowers have substantial risk of slipping and falling, especially when the surface to be cleared is slippery. These walk-behind snow blowers often require substantial upper body strength to turn. Both stand-on and sit-on versions of ride-on snow blowers require much less walking, and therefore have less risk inherent to walking and also require less physical exertion for turning, but the effort and time required to get in and out of the seat of a sit-on can be substantial. Stand-on snow blowers have been well received for several reasons, including the ability to be mounted and dismounted and turned without substantial physical exertion by the operator.

Typically, stand-on snow blower machines are 4×4 with all powered wheels providing skid-steer style zero-turning. Such designs would provide a more massive system which, in certain situations such as in deep snow, might outperform walk-behind snow blowers and, with projects requiring many stops, e.g. to do hand shoveling, they can often outperform the ride-on style snow blowers. Such stand-on systems worked especially well on long and relatively wide pathways.

While these types of stand-on snow blowing systems may have many advantages in particular applications, they also have some drawbacks. For example, in many sidewalk snow removal projects, it is often not practical to use such 4×4 systems if the sidewalk is only four (4) feet wide. These 4×4 systems are typically not capable of turning around completely on the sidewalk. This can be especially problematic for these heavy systems if these sidewalks are directly adjacent to very delicate areas, such as areas with exposed or shallow irrigation systems.

Consequently, there exists a need for improved methods and apparatuses for efficiently removing snow from narrow pathways.

SUMMARY OF THE INVENTION

It is an object of the present invention to provide an efficient and easily turned around, stand-on snow blower over a wide range of operating scenarios.

It is a feature of the present invention to utilize a stand-on snow blower with only a single powered wheel on each of the right side and the left side of the machine.

It is an advantage of the present invention to provide for increased efficiency of snow removal for projects where the area of contact of the machine to the surface to be cleared is only four feet wide.

It is yet another feature of the present invention to provide a centrally stowed hand shovel which can be easily accessed from either side when stepping off the machine.

It is another advantage to allow for efficiently addressing very short and frequent detailed hand shoveling tasks to occur quickly and minimize the effort, and often danger, of walking during the snow removal process.

It is yet another feature of the present invention to include a winch for elevating the snow blower head and a snow blower head load bearing pin to maintain an elevated position of the snow blower head while permitting use of the winch for other purposes The present invention is an apparatus and method for efficiently and cost effectively providing a stand-on zero-turn snow blower machine which is designed to satisfy the aforementioned needs, provide the previously stated objects, include the above-listed features, and achieve the already articulated advantages. The present invention is carried out in an "encroachment-less" manner, in a sense that the occasions of disturbing fragile adjacent areas is eliminated, or at least greatly reduced, in many applications.

Accordingly, the present invention is a method of removing snow comprising the steps of:

- providing a powered stand-on snow blower having only one powered drive wheel on each of opposing rear sides of the snow blower, and a forward non-powered caster at a location forward of each of the powered drive wheels;
- providing a snow blower disposed forward of each of said forward non-powered caster wheels;
- standing on the snow blower driving it down a four foot wide sidewalk while blowing the snow off the sidewalk;
  - stepping off the snow blower with the auger running;
  - automatically turning off the engine thereby stopping the powered rotation of the auger and the powered drive wheels;
- automatically slightly ejecting a portion of the shovel handle from the shovel receiving bracket head portion;
- removing the shovel and using it to shovel an area adjacent to the area where the snow has just been blown off the sidewalk;
- stepping back on the switched stand-on platform 310 and engaging the shovel with the shovel retention bracket 400;
- re-starting the engine and continuing to drive the snow blower down the sidewalk; and
- turning around the snow blower and driving the snow blower back over a portion of the sidewalk where the snow has just been removed, without any portion of any of the two powered drive wheels or the non-powered casters leaving the four foot wide sidewalk.

Additionally, the present invention is a system including a stand-on snow blower comprising:

- a frame;
- a motor supported by said frame;
- a snow blower head, pivotally coupled to said frame and powered by said motor;
- a plurality of wheels including:
  - an unpowered right front caster, a right rear powered wheel, an unpowered left front caster and a left rear powered wheel;
  - where said right rear powered wheel and said left rear powered wheel are the only powered wheels in said plurality of wheels; and
  - where each of said plurality of wheels are in combination, sized and configured to couple to said frame in a way that said stand-on snow blower can be driven by said motor to turn three hundred sixty (360) degrees while each of said plurality of wheels is constantly remaining in a circle having a maximum diameter of 48 inches.

Additionally, the present invention is a stand-on snow blower comprising:

a frame;

a snow blower head pivotally coupled to said frame;

a winch coupled to said frame configured to raise said snow blower head in response to pulling an elongated member onto a spool, and to maintain a constant angular orientation of said snow blower head with respect to said frame when said elongated member stops being pulled onto said spool;

a snow blower head angular orientation locking system having:

a first snow blower head load bearing member;

where a support portion of said snow blower head surface feature thereon configured to engage with said first snow blower head load bearing member, and a front portion of said frame which has a surface feature thereon configured to engage with said first snow blower head load bearing member; and where said snow blower head angular orientation locking system is configured to maintain said snow blower head at a constant angular orientation with respect to said frame, without any connection between a terminal end of said elongated member and said snow blower head.

BRIEF DESCRIPTION OF THE DRAWINGS

The invention may be more fully understood by reading the foregoing description of the preferred embodiments of the invention, in conjunction with the appended drawing wherein.

DETAILED DESCRIPTION

Although described with particular reference to a stand-on snow blower, (such as a 2×4 with one powered wheel and one unpowered caster per side) the system and method for removing snow can be implemented in many different types of stand-on snow blowers with only two powered wheels.

In an embodiment, the system and method for removing snow can be implemented on a ride-on machine which is capable of receiving a snow blower or a snow broom.

The details below should be viewed as examples of many potential variations of the present invention which are protected hereunder.

Figure 1:
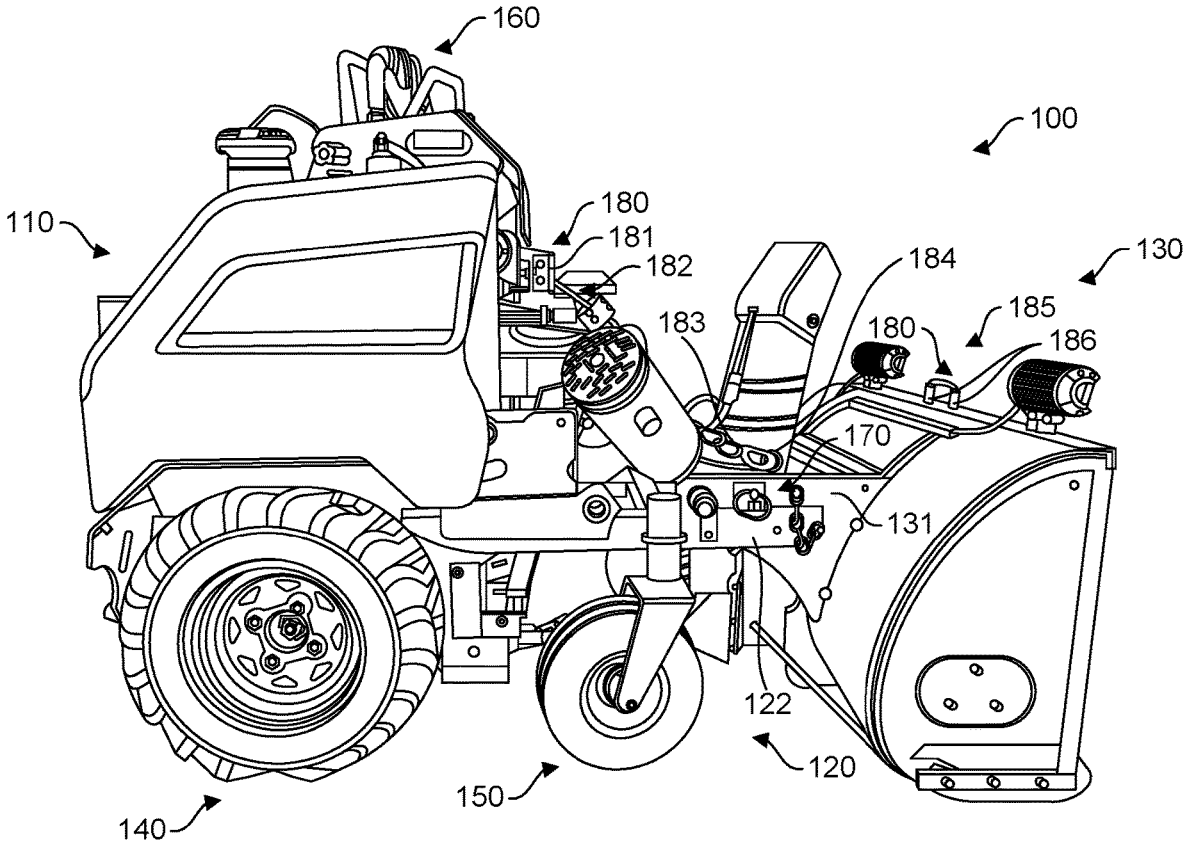
FIG. 1 is a side view of an embodiment of the present invention.

FIG. 1 is a side view of the stand-on snow blower, generally designated 100 of the present invention, which includes a rear operator stand-on portion 110, which can, in many ways, be identical to a rear operator stand-on portion of a V Ride 2 power mower manufactured by Scag Power Equipment of Mayville, Wis., or a suitable substitute. Also shown are: mid caster and attachment zone 120, snow blower head 130, right side powered rear wheel 140, right side unpowered caster 150, which is preferably a two axis freewheeling swivel caster, operator hand controls 160, (which may be identical to those of the V Rider 2 power mower except that the control for engaging rotation of the mower blades on the mower is used in the present invention to control the rotation of the snow blower auger), right side attachment elevation locking assembly 170 and winch system 180, which collectively refers to winch 181, elongated cable 182, hook 183, snow blower head lift structure 184, elongated cable guide 185 with freewheeling cylinders 186. In the configuration of the present invention as shown in FIG. 1, the overall length of the system 100 is approximately 62 inches, which makes it able to be driven and/or pulled up a ramp into a back portion of most full sized pickup trucks, including those with 6 foot beds. The width of the present invention also allows it to be located between the wheel wells.

Figure 2:
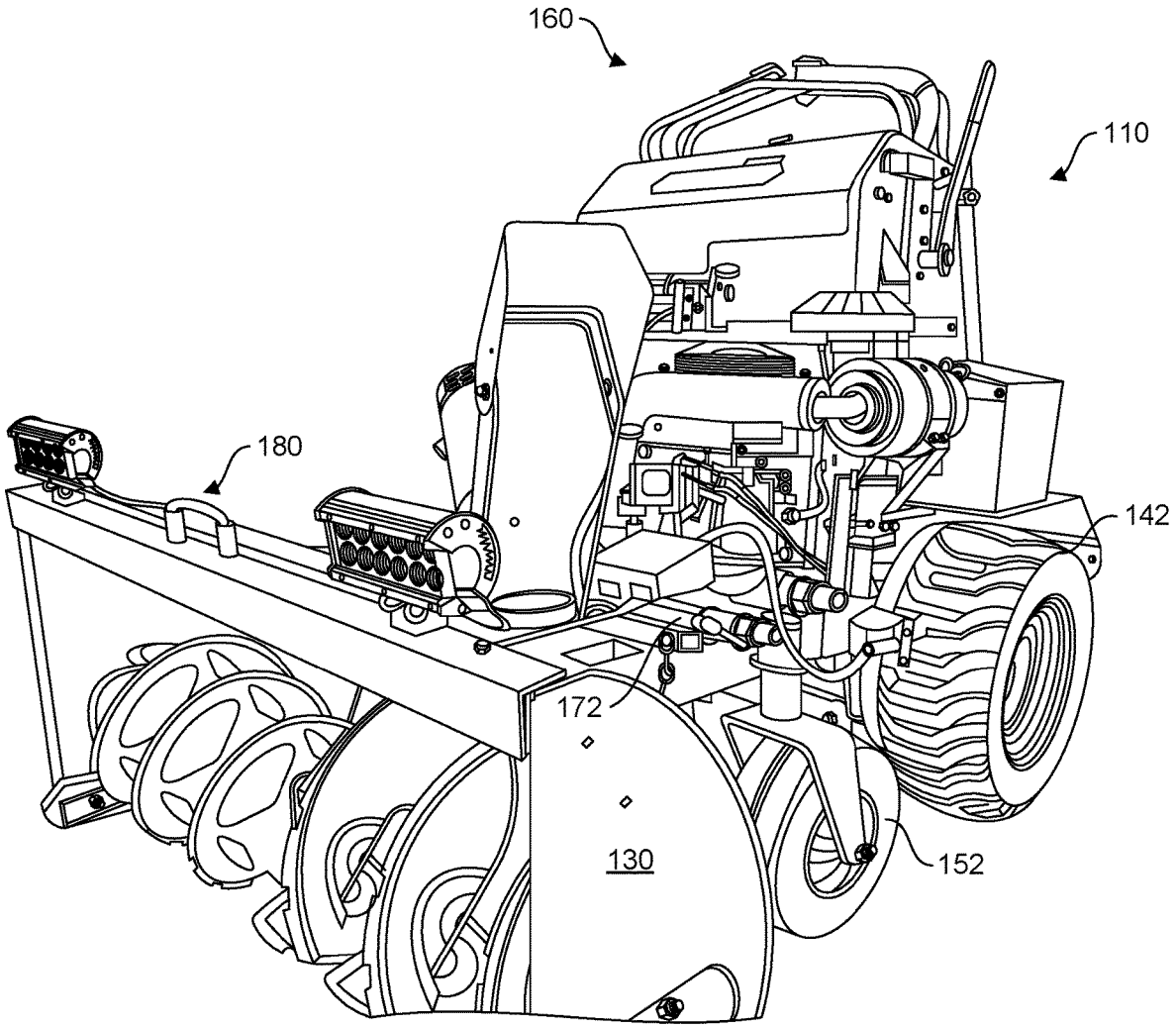
FIG. 2 is a perspective view of the present invention shown in FIG. 1.

Now at first generally referring to FIG. 2, there is shown the left side powered rear wheel 142, left side unpowered caster 152, which is preferably a two axis freewheeling swivel caster, and left side attachment elevation locking assembly 172. The stand-on snow blower of the present invention is preferably steering by commanding the powered rear wheels to turn with different velocities and where said unpowered right front caster and said unpowered left front caster are free of any connection to a steering system which changes direction of a caster thereby causing the stand-on snow blower to change direction in response thereto.

Figure 3:
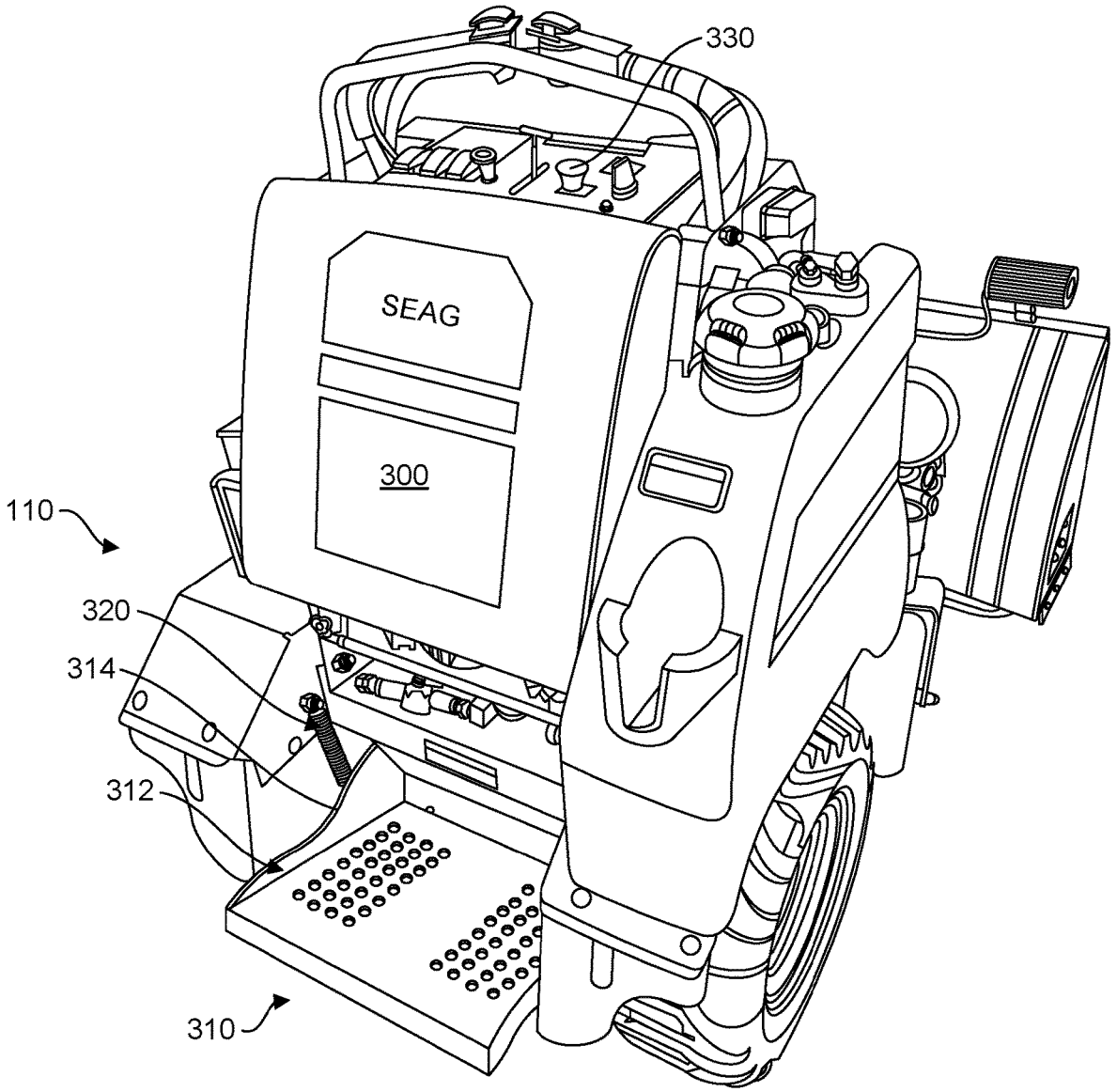
FIG. 3 is rear perspective view of the present invention without the central shovel retention bracket in place.

Now referring to FIG. 3, there is shown an abdominal pad 300, a switched stand-on platform 310, platform side with differential height characteristic 312, with a platform side edge portion 314, a stand-on platform spring 320, and engagement control 330, which all could be very similar to or identical to OEM parts on the power mower described above.

Figure 4:
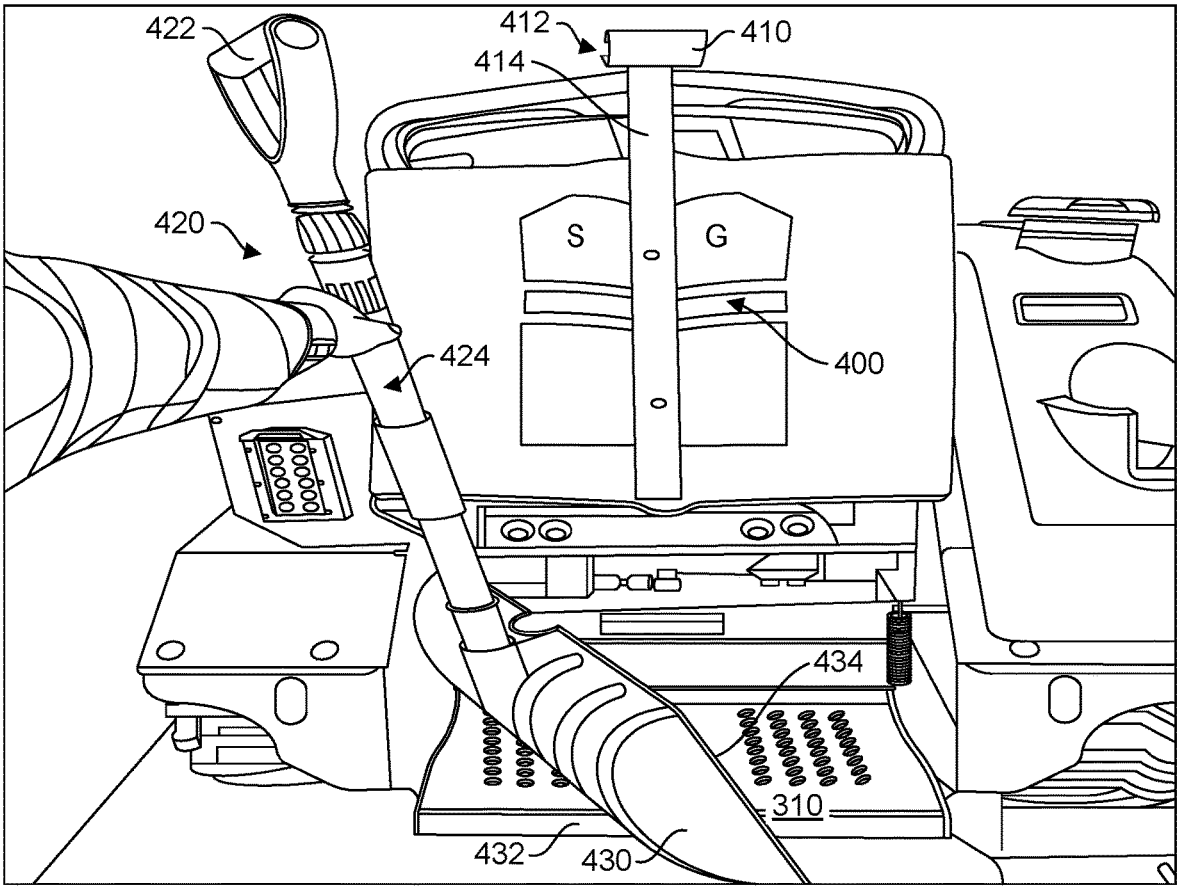
FIG. 4 is a rear perspective view with the central shovel retention bracket in place.

Now referring to FIG. 4, there is shown the abdominal pad 300 of FIG. 3 after the attachment therethrough of a shovel retention bracket 400, which includes a shovel receiving bracket head portion 410, shovel receiving bracket head portion handle receiving opening 412, and a shovel receiving bracket longitudinal portion 414. Also shown is a shovel 420 with a shovel handle 422, a shovel longitudinal portion 424, which could have an adjustable length characteristic, and a shovel scoop portion 430 having a shovel scoop portion back side 432, and a shovel scoop portion open front side 434, and a shovel scraping edge 436 (FIG. 5).

Figure 5:
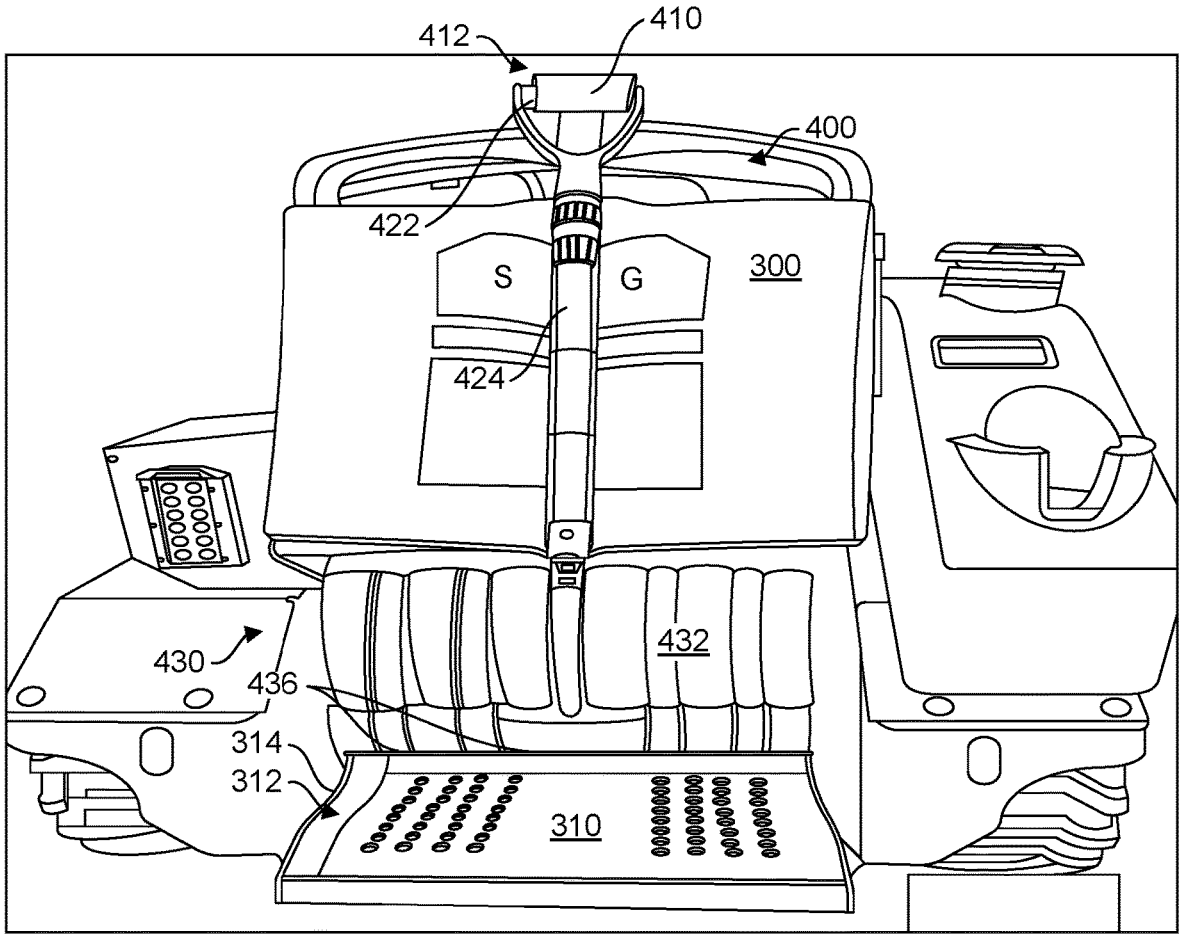
FIG. 5 is another rear perspective view with a shovel disposed in the central shovel retention bracket.

Now referring to FIG. 5, there is shown the system of FIG. 4 where the shovel 420 is installed in the shovel retention bracket 400.

The precise implementation of the present invention will vary depending upon the particular application. For example, in some embodiments, platform side with differential height characteristic 312 may be different from any OEM mower platform side so as to allow for engagement of the shovel scraping edge 436 to contact a platform side edge portion 314 at a height to permit the shovel 420 to be automatically very slightly ejected from the shovel retention bracket 400 when the operator steps off the switched stand-on platform 310, thereby making quick shovel removal possible. Adjustment of the length of shovel longitudinal portion 424 can accommodate operator preferences regarding automatic shovel handle ejection and/or retention, and clearance for operator footwear under the shovel scraping edge 436.

The kill switch of the Scag V Ride 2 mower has been repurposed for the automatic shutting off of the engine (not shown) which is coupled to and drives each of the right side powered rear wheel 140 and the left side powered rear wheel 142 whenever the operator steps off the switched stand-on platform 310, and either the snow blower auger is engaged or the parking brake is not engaged.

Figure 6:
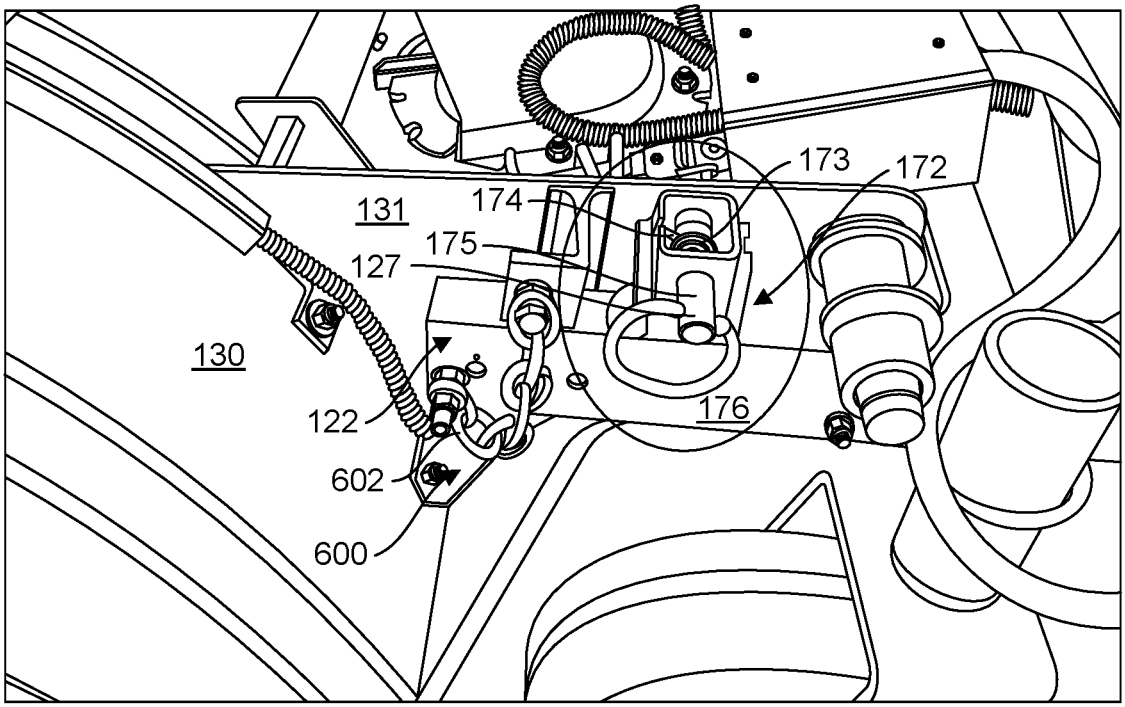
FIG. 6 is a close up view of a portion of the present invention with the left side attachment elevation locking assembly 172 and its immediate surroundings shown in a close up view.

Now referring to FIG. 6, there is shown a close up of the left side attachment elevation locking assembly 172 shown in a disengaged non-elevated configuration where the snow blower load bearing pin 175 is removed from a hole (not shown) in snow blower support extension 131 and held in a disengaged configuration by rotating latch pin 174 disposed in a slot in structure coupled to frame portion 122. In this disengaged configuration, the snow blower would be able to float with the terrain. If the snow blower head 130 were lifted by the winch, or any other means, and the snow blower load bearing pin 175 were aligned with one of a potential plurality of predetermined holes in the snow blower support extension 131, corresponding to predetermined angles of elevation, and the pin 175 were rotated so that rotating latching pin 174 is removed from the slot and thereby allowing the spring 173 to push the load bearing pin 175 into a predetermined hole in the snow blower support extension 131, the snow blower head 130 could be held in an elevated configuration without using the winch or other means. It should be understood that the right side attachment elevation locking assembly 170 would also be ideally used. Also shown in FIG. 6 is a snow blower head elevation limiting system 600, which includes a chain 602 bolted at one end to a frame portion 122 and at the other end to a portion of snow blower support extension 131. This means for limiting elevation of the snow blower head is one embodiment. The means for limiting elevation of the snow blower is also down in the downward direction in this embodiment of the present invention by a rigid mechanical stop. It is contemplated that all of the means for limiting elevation of the snow blower head could be rigid mechanical stops or a different combination of flexible members and rigid mechanical stops. These stops are particularly important when an extendable drive shaft is used as a means for transferring power from the motor to an auger in the snow blower head. If the means for transferring power from the motor to an auger in the snow blower head is a hydraulic system, these stops may be eliminated in some embodiments.

Figure 7:
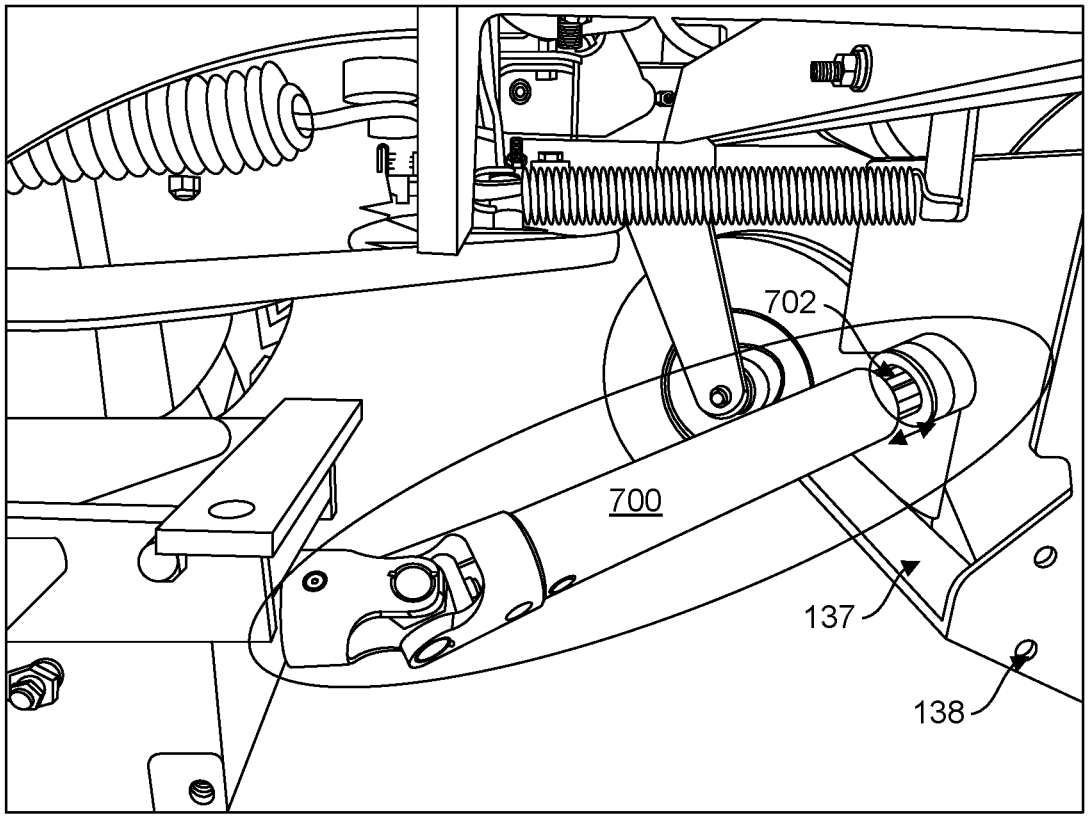
FIG. 7 is a view of the an embodiment of snow blower head and power transfer means of the present invention with the snow blower head in a downward orientation.
Figure 8:
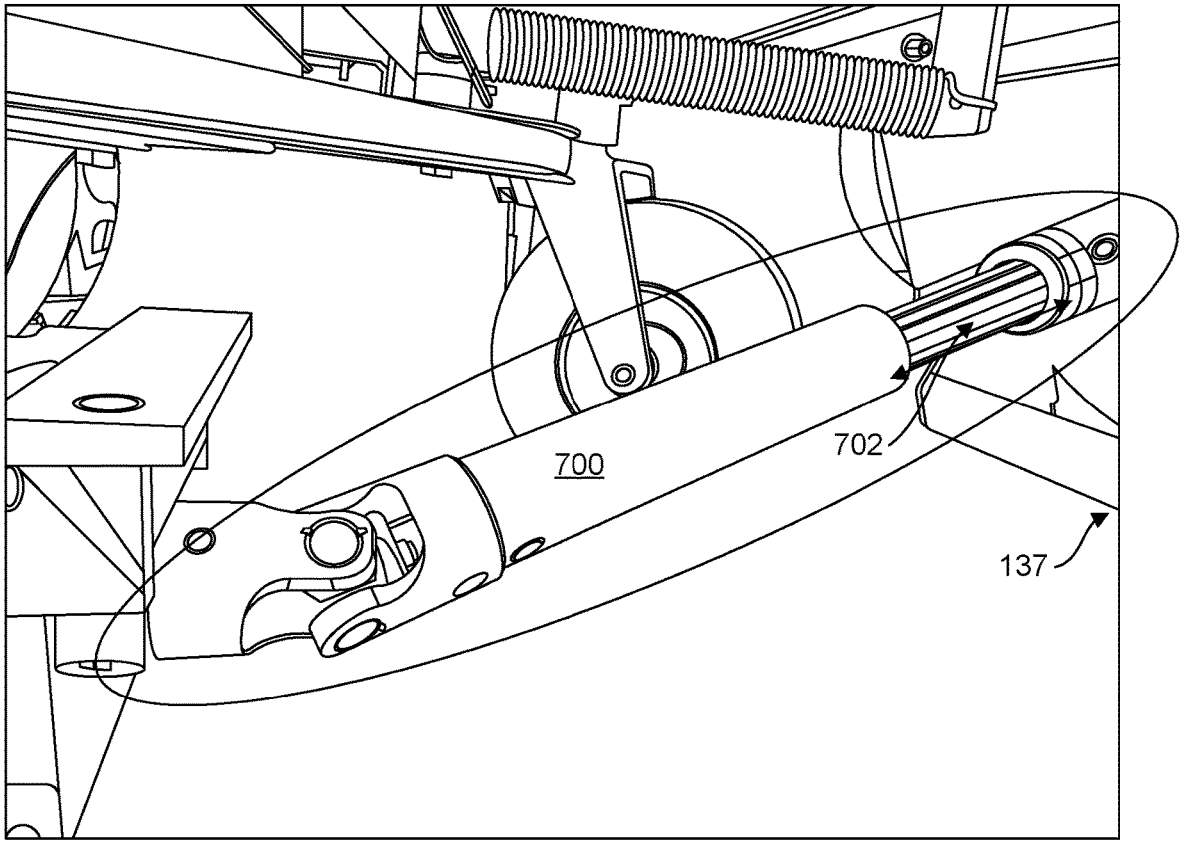
FIG. 8 is a view of the embodiment of FIG. 7 with the snow blower head in a raised orientation.
Figure 9:
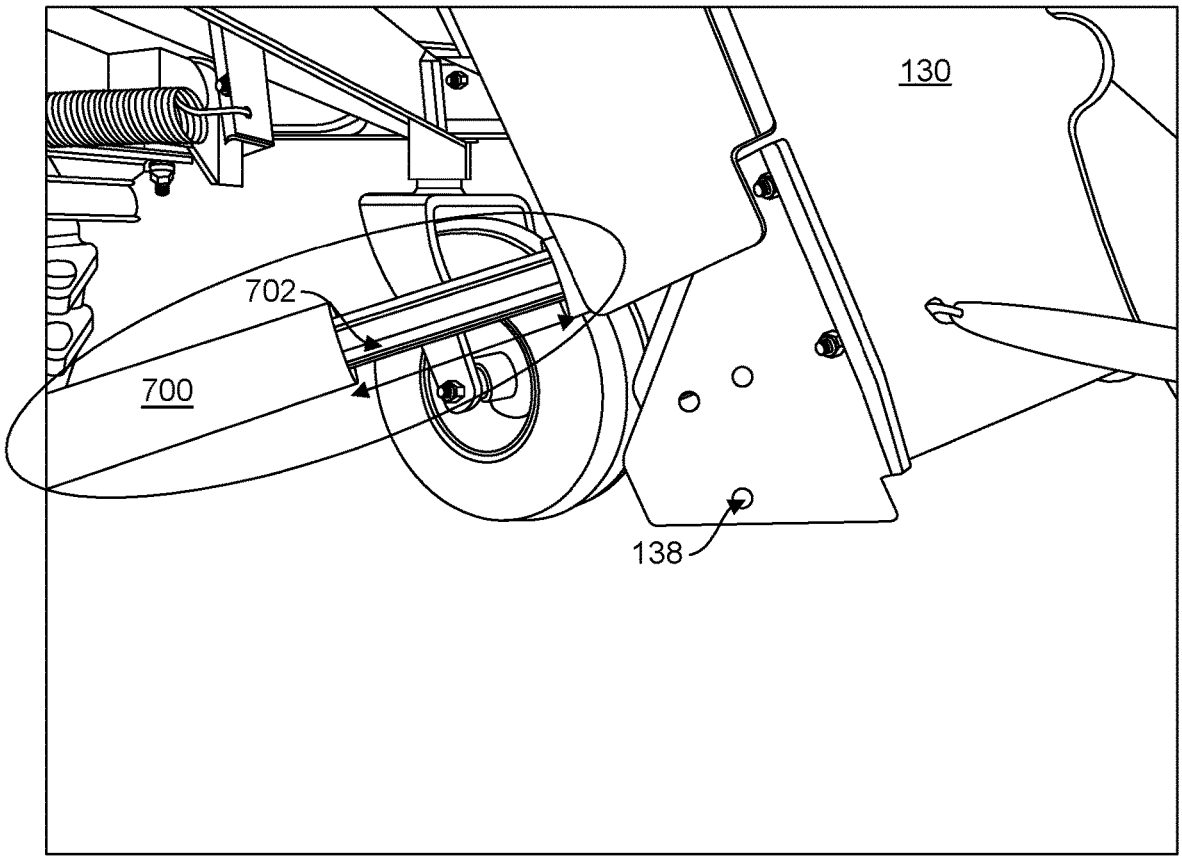
FIG. 9 is another view of the embodiment of FIG. 7 with the snow blower head in a raised orientation.

Now referring to FIGS. 7, 8 and 9, the snow blower head is shown with an extendable drive shaft 700 coupled thereto for providing power from the motor to turn an auger in the snow blower head 130. The angular orientation of the extendable drive shaft 700 and the hole 137 provide reference points for the configuration of this embodiment of the means for transferring power from the motor to the auger in the snow blower head. Other means for transferring power from the motor to the auger in the snow blower head include a hydraulic servos/motors and/or pumps, hydraulic lines, quick connects and other components of hydraulic systems, flexible drive shaft systems, as well as belt and pulley systems. In the embodiment shown in FIGS. 7-9, the gap 702 with its variable dimension illustrates how this one means for transferring power from the motor to the auger in the snow blower head would be configured with differing orientations of the snow blower head 130.

The innovative method of cleaning snow comprises the steps of:

providing a powered stand-on snow blower having only one powered drive wheel on each of opposing rear sides of the snow blower, and a forward non-powered caster wheel at a location forward of each of the powered drive wheels;

providing a snow blower disposed forward of each of said forward non-powered caster wheels;

standing on the snow blower driving it down a four foot wide sidewalk while blowing the snow off the sidewalk;

stepping off the snow blower with the auger running;

automatically turning off the engine thereby stopping the powered rotation of the auger and the powered drive wheels;

automatically slightly ejecting a portion of the shovel handle from the shovel receiving bracket head portion;

removing the shovel and using it to shovel an area adjacent to the area where the snow has just been blown off the sidewalk;

stepping back on the switched stand-on platform 310 and engaging the shovel with the shovel retention bracket 400; and starting the engine;

turning around the snow blower, without any portion of any of the two powered drive wheels or the non-powered caster wheels leaving the four foot wide sidewalk, and driving the snow blower down the sidewalk where the snow thereon has just been removed.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred exemplary embodiment thereof.

I claim:

1. A stand-on snow blower comprising:

a frame;

a motor supported by said frame;

a snow blower head, pivotally coupled to said frame and powered by said motor;

a winch coupled to said frame and configured to selectively pivot said snow blower head with respect to said frame and to maintain said snow blower head at a constant angular orientation with respect to said frame;

a plurality of wheels including:

an unpowered right front caster, a right rear powered wheel, an unpowered left front caster and a left rear powered wheel;

where said right rear powered wheel and said left rear powered wheel are the only powered wheels in said plurality of wheels;

where each of said plurality of wheels are in combination, sized and configured to couple to said frame in a way that said stand-on snow blower can be driven by said motor to turn 360 degrees while each of said plurality of wheels is constantly remaining in a circle having a maximum diameter of 48 inches;

a snow blower head angular orientation locking system which comprises:

a first snow blower head load bearing pin;

where a support portion of said snow blower head has a hole therethrough configured to receive therein said first snow blower head load bearing pin, and a front portion of said frame has a hole therethrough configured to receive therein said first snow blower head load bearing pin; and where said snow blower head angular orientation locking system is configured to maintain said snow blower head at a constant angular orientation with respect to said frame, without any use of said winch.

2. The stand-on snow blower of claim 1 further comprising: a means for transferring power from the motor to an auger in the snow blower head.

3. The stand-on snow blower of claim 2 wherein said means for transferring power from the motor to an auger in the snow blower head comprises an extendable drive shaft.

4. The stand-on snow blower of claim 1 further comprising an extendable drive shaft coupled between the motor and the snow blower head.

5. A stand-on snow blower comprising:

a frame;

a motor supported by said frame;

a snow blower head, pivotally coupled to said frame and powered by said motor;

a plurality of wheels including:

an unpowered right front caster, a right rear powered wheel, an unpowered left front caster and a left rear powered wheel;

where said right rear powered wheel and said left rear powered wheel are the only powered wheels in said plurality of wheels;

where each of said plurality of wheels are in combination, sized and configured to couple to said frame in a way that said stand-on snow blower can be driven by said motor to turn 360 degrees while each of said plurality of wheels is constantly remaining in a circle having a maximum diameter of 48 inches;

a shovel retention bracket having a shovel receiving bracket head portion with a shovel receiving bracket head portion handle receiving opening therein;

said shovel receiving bracket head portion is coupled to a shovel receiving bracket longitudinal portion; and said shovel retention bracket is centrally disposed on an abdominal pad.

6. The stand-on snow blower of claim 5 wherein said shovel retention bracket is configured to retain a shovel having a shovel longitudinal portion.

7. The stand-on snow blower of claim 6 wherein said shovel has a shovel handle configured to cooperate with said shovel receiving bracket head portion handle receiving opening.

8. The stand-on snow blower of claim 7 further comprising a stand-on platform.

9. The stand-on snow blower of claim 8 wherein, in combination, said shovel retention bracket, said shovel longitudinal portion, and said stand-on platform are configured to cause said shovel handle to slightly move upward from said shovel receiving bracket head portion when an operator of said stand-on snow blower steps off said stand-on platform.

* * * * *